US006176473B1

(12) United States Patent
Stanek et al.

(10) Patent No.: US 6,176,473 B1
(45) Date of Patent: Jan. 23, 2001

(54) HUMIDIFIER BOTTLE ASSEMBLY HAVING TWO BOTTLES AND A COMPARISON DEVICE TO DETERMINE WHICH BOTTLE HAS MORE WATER

(75) Inventors: Terrence L. Stanek, St. Charles; Mark J. Tomasiak, O'Fallon, both of MO (US)

(73) Assignee: Emerson Electric Co., St. Louis, MO (US)

( * ) Notice: Under 35 U.S.C. 154(b), the term of this patent shall be extended for 0 days.

(21) Appl. No.: 09/168,594

(22) Filed: Oct. 8, 1998

(51) Int. Cl.[7] ..... B01F 3/04

(52) U.S. Cl. ..... 261/26; 261/67; 261/72.1; 261/107; 261/DIG. 34; 261/DIG. 65

(58) Field of Search ..... 261/26, 67, 72.1, 261/104, 107, DIG. 34, DIG. 46, DIG. 65

(56) References Cited

U.S. PATENT DOCUMENTS

| | | | | |
|---|---|---|---|---|
| 4,921,639 | * | 5/1990 | Chiu | 261/67 |
| 5,037,583 | | 8/1991 | Hand | 261/26 |
| 5,110,511 | | 5/1992 | Hand | 261/104 |
| 5,397,510 | * | 3/1995 | Clark | 261/26 |
| 5,529,726 | | 6/1996 | Glenn | 261/142 |
| 5,688,446 | | 11/1997 | Glenn | 261/142 |

FOREIGN PATENT DOCUMENTS

| | | | | |
|---|---|---|---|---|
| 61-240049 | * | 10/1986 | (JP) | 261/72.1 |

* cited by examiner

*Primary Examiner*—David A. Simmons
*Assistant Examiner*—Robert A. Hopkins
(74) *Attorney, Agent, or Firm*—Howrey Simon Arnold & White, LLP

(57) ABSTRACT

A humidifier bottle assembly and a method of dispensing water from humidifier bottles are provided. The humidifier bottle assembly includes a first and a second humidifier bottle adapted to hold water and a humidifier bottle receptacle adapted to receive the first and second bottles. In one embodiment, the receptacle includes a device adapted to determine which of the first and second humidifier bottles contains more water. The device is operable to dispense water from the humidifier bottle containing more water. In an exemplary embodiment, the device comprises a pivot mechanism configured to raise one of the first and second bottles and lower the other of the first and second bottles within the receptacle, so as to activate a dispensing plunger and stopper, thus dispensing water from the bottle containing more water. In another embodiment, each bottle includes a dispensing mechanism adapted to dispense water from the bottle into a reservoir. A pivot member is provided about which the bottles pivot, and at least one biasing member is adapted to position the bottles in a given angular position in response to the amount of water contained in the bottles, such that the dispensing mechanisms of the first and second bottles are alternately positioned below the water level of the water in the reservoir.

15 Claims, 8 Drawing Sheets

HUMIDIFIER BOTTLE ASSEMBLY HAVING TWO BOTTLES AND A COMPARISON DEVICE TO DETERMINE WHICH BOTTLE HAS MORE WATER

BACKGROUND OF THE INVENTION

1. Field of the Invention

The present invention relates generally to humidifiers, and, more particularly, to a humidifier bottle assembly that alternately dispenses water from two or more humidifier bottles.

2. Description of the Related Art

Humidifiers are commonly used in homes to add moisture to the air, particularly during the winter months, when the air typically has low moisture content. The added moisture content in the air during these dry, cold weather months provides for a more comfortable environment within the home. As a result, humidifiers have become a popular, inexpensive means for achieving optimal air moisture content within the home environment.

One difficulty commonly encountered with humidifiers, however, is the inability to determine the water level of a humidifier bottle with relative ease. Some humidifiers have an elongated clear plastic strip (i.e., a window) on their side such that one can view the bottle compartment of the humidifier. Typically, an individual will rely on direct visual sighting of the bottle's water level through this clear plastic strip to determine the amount of water contained therein. Since most humidifiers are compact in size and are placed on the floor, such viewing of the water level typically requires one to bend down to view the plastic strip of the humidifier. Viewing the water level within close proximity to the humidifier is generally needed since water is colorless, and it is often difficult to ascertain such water level at a distance. Thus, the action of bending down to the humidifier, while being inconvenient to any one individual, is even more burdensome to those who have difficulty accomplishing such, especially the elderly.

Some types of humidifiers utilize two humidifier bottles rather than a single bottle. Two-bottle humidifiers provide several advantages over the single bottle variety. For instance, the two-bottle variety generally permits operation of the humidifier while an individual is re-filling one of the bottles with water, thereby providing continuous operation of the humidifier. In addition, the humidifier bottles of the two-bottle variety tend to be more manageable (i.e., smaller in size) than that of the single bottle variety, thus easing the process of filling the bottles with water in space-constrained areas, such as a bathroom sink. Accordingly, the two-bottle type humidifier facilitates more convenient handling of such containers by an individual than that of the single bottle variety.

While humidifiers of the two-bottle variety provide several advantages over the single-bottle type, they also suffer from their own disadvantages. Typically, humidifiers employing two bottles will empty one of their bottles completely before the second bottle will begin to empty. If an individual refills the first bottle with water as soon as it empties, it will again begin to empty, causing a significant amount of water to still remain within the second bottle. If this refilling sequence continues, the water in the second bottle will undesirably stagnate.

The present invention is directed to overcoming, or at least reducing the effects of, one or more of the problems set forth above.

SUMMARY OF THE INVENTION

In one aspect of the present invention, a humidifier bottle assembly is provided. The humidifier bottle assembly includes a first and a second humidifier bottle adapted to hold water and a humidifier bottle receptacle adapted to receive the first and second bottles. The receptacle includes a device adapted to determine which of the first and second humidifier bottles contains more water. The device is operable to dispense water from the humidifier bottle containing more water. In an exemplary embodiment, the device comprises a pivot mechanism configured to raise one of the first and second bottles and lower the other of the first and second bottles within the receptacle, so as to activate a dispensing plunger and stopper, thus dispensing water from the bottle containing more water.

In a further aspect of the present invention, a humidifier bottle assembly includes a first and a second humidifier bottle adapted to hold water, with each bottle including a dispensing mechanism adapted to dispense water from the bottle into a reservoir. A pivot member is provided about which the bottles pivot, and at least one biasing member is adapted to position the bottles in a given angular position in response to the amount of water contained in the bottles, such that the dispensing mechanisms of the first and second bottles are alternately positioned below the water level of the water in the reservoir.

In another aspect of the invention, a method for dispensing water from a humidifier bottle assembly including at least two humidifier bottles for holding water is provided. The method includes the steps of determining which of the humidifier bottles contains more water than the other humidifier bottle, and dispensing water from the humidifier bottle containing the most water.

BRIEF DESCRIPTION OF THE DRAWINGS

Other objects and advantages of the invention will become apparent upon reading the following detailed description and upon reference to the drawings in which.

Figure 1:
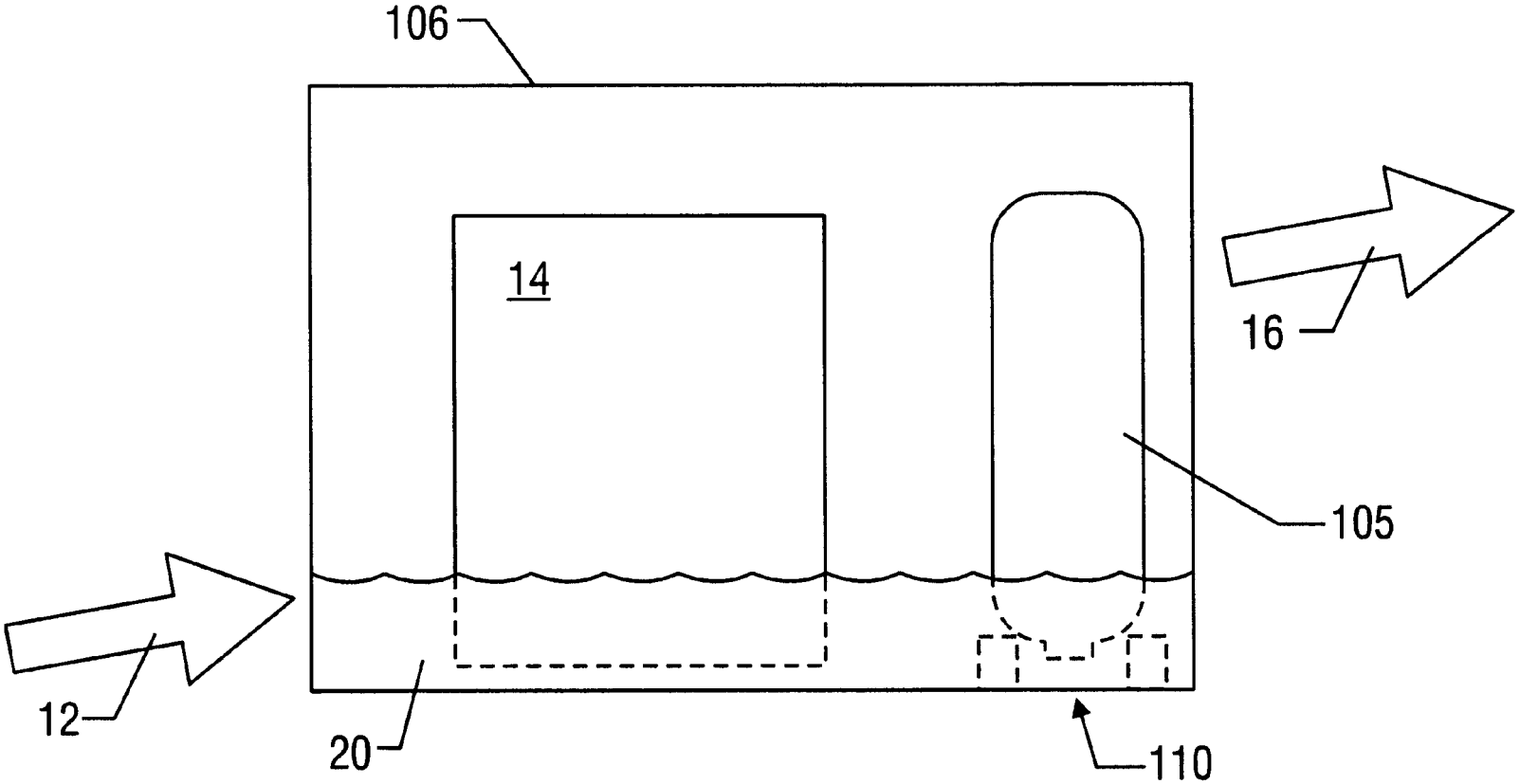
FIG. 1 illustrates the operating principle of a humidifier in accordance with the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nonetheless be a routine undertaking for those of ordinary skill in the art having the benefit of this disclosure.

FIG. 1 illustrates the operating principle of a humidifier 100 in accordance with the invention. A stream of dry air 12 enters the humidifier 100 through an intake and passes through or over a wet wick 14 and picks up additional moisture to form a humid stream of air 16. The humid stream of air 16 leaves the humidifier by an output. One end of the wick 14 makes contact with water in a reservoir 20. Water from the reservoir 20 replenishes water carried away from the wick 14 by the stream of air 16. At least one humidifier bottle 105 is situated within a humidifier bottle receptacle 110 so as to supply water to the reservoir 20.

Figure 2:
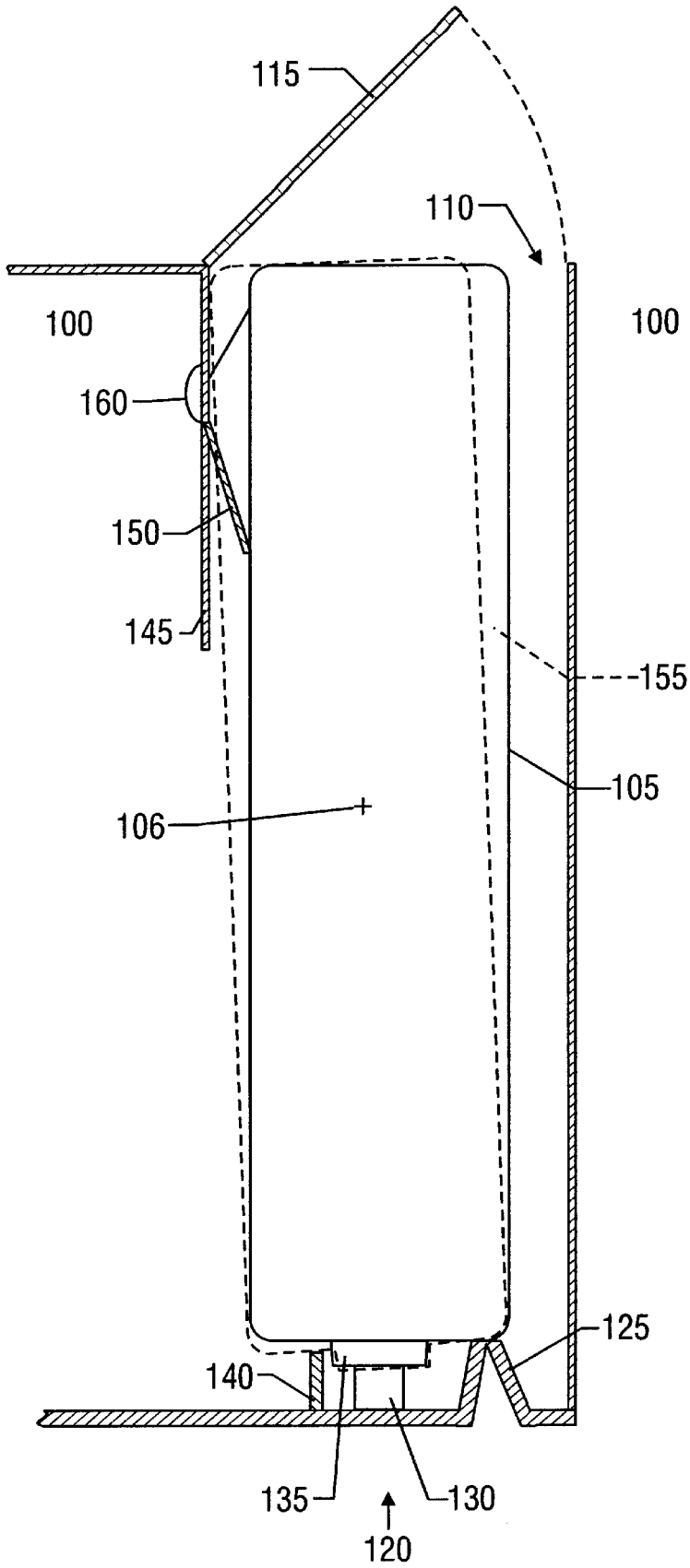
FIG. 2 shows a partial, cross-sectional view of a humidifier and a humidifier bottle assembly disposed within a receptacle of the humidifier.

Turning now to FIG. 2, a cross-sectional view of a portion of the humidifier 100, having the humidifier bottle 105 disposed within the humidifier bottle receptacle 110, is shown in accordance with one embodiment. The humidifier bottle 105 supplies water to the humidifier 100. When necessary, an individual removes the humidifier bottle 105 from the receptacle 110, fills the bottle 105 with water, and subsequently places the bottle 105 back into the receptacle 110. In the embodiment illustrated, access to the humidifier bottle receptacle 110 is achieved via a hinged flap 115 on the top surface of the humidifier 100.

The humidifier bottle receptacle 110 includes a mounting seat 120, which extends from the bottom of the humidifier 100, and provides vertical support to the humidifier bottle 105 via a pivot point 125 about which the humidifier bottle 105 may pivot. The mounting seat 120 further includes a water dispensing actuator 130 for actuating a dispensing cap 135 on the bottom of the humidifier bottle 105. The dispensing cap 135 discharges water from the humidifier bottle 105 when actuated by the dispensing actuator 130.

The mounting seat 120 further includes a support 140, extending vertically from the bottom surface of the humidifier 100, which is shorter in length than the pivot point 125 by a predetermined length. The height differential between the pivot point 125 and the support 140 allows the humidifier bottle 105 to tilt towards a side wall 145 of the humidifier bottle receptacle 110 as the bottle 105 pivots about the pivot point 125. The support 140 is not essential to the operation of the invention, as the humidifier bottle 100 could rest against the sidewall 145 when in a tipped position. The sidewall 145 includes a biasing member 150 mounted thereon, which provides a horizontal resistance against the humidifier bottle 105 when leaning towards the sidewall 145. The biasing member 150 is adapted such that it attempts to situate the humidifier bottle 105 in a given angular position in response to the amount of water contained in the humidifier bottle 105.

In the particular embodiment illustrated, the humidifier bottle 105 is positioned relative to the pivot point 125 so that the center of gravity 106 of the humidifier bottle 105 is to the left of the pivot point 125 (as viewed in FIG. 2). Thus, the humidifier bottle 105 will tend to tip towards the sidewall 145. The biasing member 150 is configured such that it attempts to situate the humidifier bottle 150 orthogonal to the bottom surface of the humidifier 100 by pushing the bottle 105 in an upright or vertical position. In accordance with one embodiment, the biasing member 150 is a plastic tab; however, it will be appreciated that the biasing member 150 could be embodied as a coil spring or other elastic-type material without departing from the spirit and scope of the present invention.

When the humidifier bottle 105 is empty, the biasing member 150 applies a force to the upper portion of the bottle 105 such that it is situated in a generally vertical position, approximately perpendicular to the bottom surface of the humidifier 100. When the humidifier bottle 150 contains water, however, the humidifier bottle 150 overcomes the force of the biasing member 150 and pivots about the pivot point 125 from the vertical position towards the sidewall 145. When the humidifier bottle 105 is filled with water to its maximum capacity, applies maximum pressure to the biasing member 150. The tilt of the humidifier bottle 105 at its maximum angular displacement is indicated by the dashed line 155, which results when the bottle 105 is filled to capacity.

As the humidifier bottle 105 drains its water through the dispensing cap 135, it becomes lighter, and, consequently, applies less pressure to the biasing member 150. Thus, as the humidifier bottle 105 empties, the biasing member 150 will have more of an effect on the bottle 105 and cause it to change its angular displacement within the humidifier bottle receptacle 110 until, when the bottle 150 is empty, it is in the vertical position. The angular displacement (i.e., the tilt) of the humidifier bottle 105 is directly proportional to the amount of water contained therein. Accordingly, the amount of water remaining within the bottle 105 can be determined by its angular displacement within the receptacle 110 and the amount of force exerted by the humidifier bottle 105 against the biasing member 150.

Figure 3:
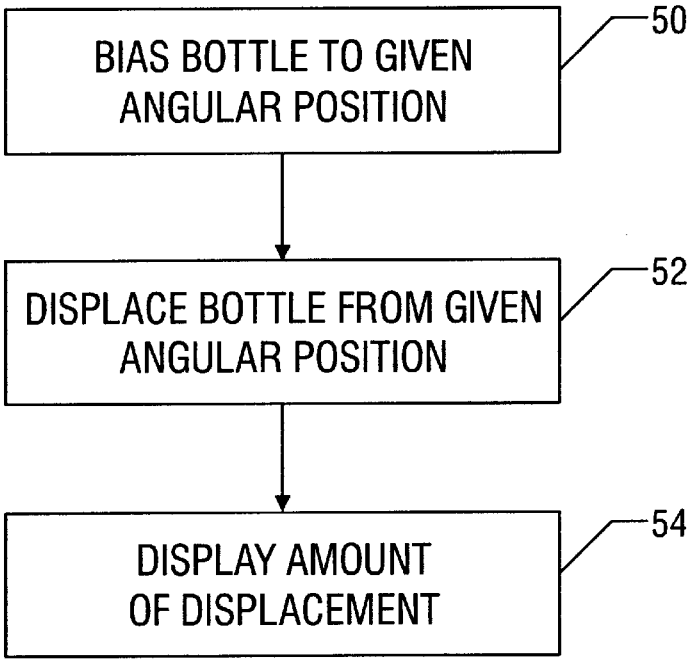
FIG. 3 depicts a process for visually conveying the water level of the humidifier bottle of FIG. 2.

Turning now to FIG. 3, a process of visually conveying the amount of water contained within the humidifier bottle 105 to an individual is shown. The process commences in block 50, with the step of biasing the humidifier bottle 105 to a given angular position when the bottle 105 is empty. In the embodiment illustrated in FIG. 2, the given position is a generally vertical position. In block 52, the humidifier bottle 105 is displaced from the given angular position as a function of the amount of water contained therein. In block 54, the amount of displacement from the given position is displayed as an indication of the amount of water held within the humidifier bottle 105.

Figure 4:
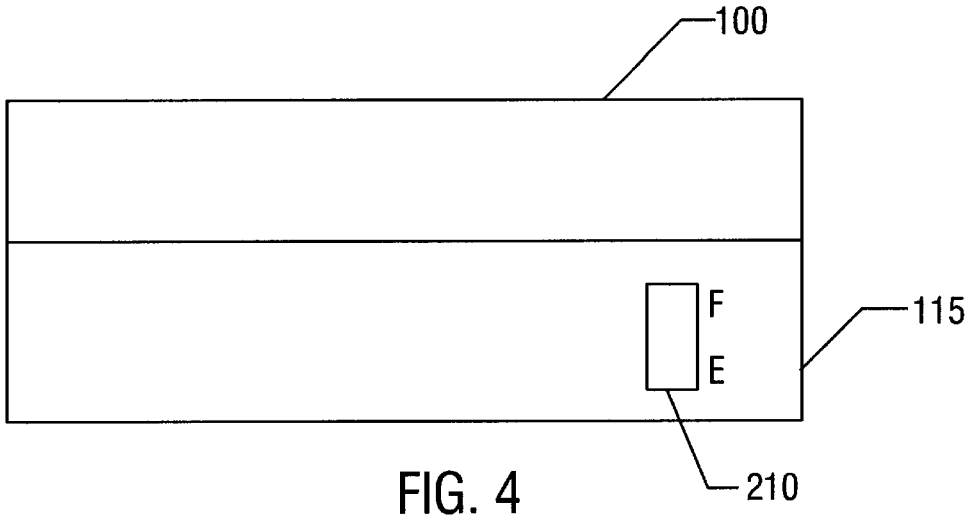
FIG. 4 illustrates a top view of the humidifier with a water level gauge disposed thereon.
Figure 5:
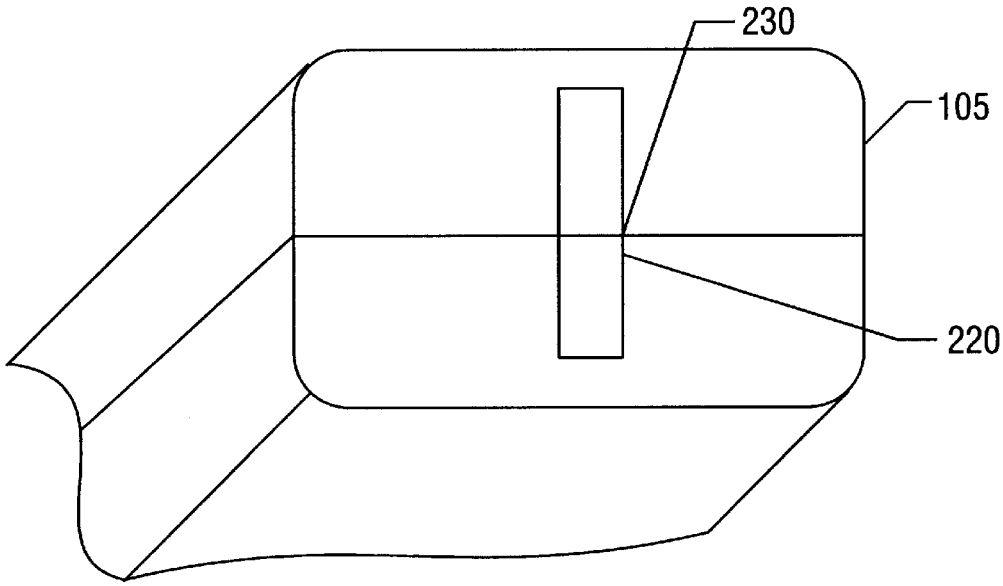
FIG. 5 shows the top of the humidifier bottle with a marker tape affixed thereto.

In one embodiment, the amount of water remaining within the bottle 105 is visually conveyed to an individual as shown in FIGS. 4 and 5. In this particular embodiment, the hinged flap 115, which covers the humidifier bottle receptacle 110, is provided with a window 210, which may be fabricated out of plastic. The window 210 provides a view of the top of the bottle 105 when housed within the receptacle 110. The top of the bottle 105 has affixed thereto a marker 220, which, in the embodiment illustrated, comprises a marking tape with a center line 230 drawn thereon. Accordingly, when the bottle 105 is disposed within the receptacle 110, the center line 230 is viewable through the window 210 of the flap 115.

As the humidifier bottle 105 empties, the bottle 105 goes from a tilting position (as designated by 155 in FIG. 2) to a vertical position when empty. As this change in tilting position occurs, the center line 230 of the marking tape 220 moves from the back to the front as viewed through the window 210, thus indicating the amount of water remaining within the bottle 105. Accordingly, an individual can ascertain the water level of the bottle 105 with relative ease by standing over the humidifier 100, and viewing the window 210. This alleviates the problems associated with the prior art wherein an individual would have to bend down to view the water level of the bottle 105 (through a window on the side of the humidifier 100) or by removing the bottle 105 from the receptacle 110 for viewing such water level.

Figure 6:
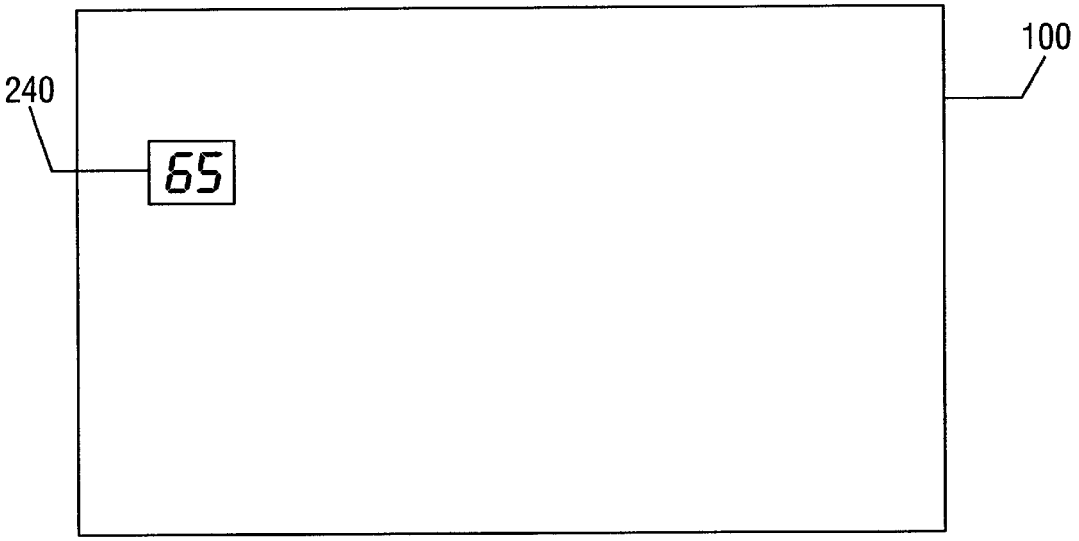
FIG. 6 illustrates of a humidifier with a digital readout, showing the amount of water present within the humidifier bottle.

Turning now to FIG. 6, the water level of the bottle 105 is visually conveyed to an individual via a digital readout 240 on the humidifier 100, in accordance with another embodiment. The digital readout 240 may be embodied for example as either an LED or LCD. However, the LED would be particularly advantageous since it enables viewing in a dark environment.

In this particular embodiment, the amount of force applied to the biasing member 150 by the humidifier bottle 105 is translated to a percentage of water remaining in the bottle 105 by a control unit (not shown), and such percentage provided on the digital readout 240. The manner in which the control unit would perform such translation from the tension of the biasing member 150 to the percentage of water remaining is well within the knowledge of one of ordinary skill in the art. Accordingly, the specifics of such process will not be disclosed herein to avoid unnecessarily obscuring the present invention.

Figure 7:
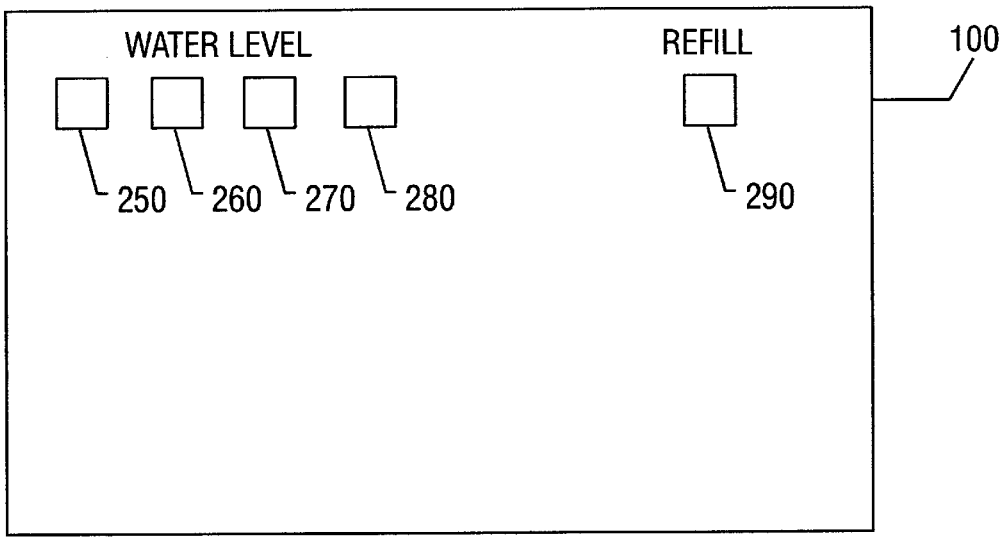
FIG. 7 illustrates a humidifier with a series of LEDs for indicating the water level of the humidifier bottle.

In alternative embodiments, at least one LED provides the visual indication regarding the amount of water contained in the bottle 105. In one exemplary embodiment, a set of four LEDs 250–280 is provided on the humidifier 100 to indicate the water level as shown in FIG. 7. In this particular embodiment, each LED 250–280 illuminated represents one-fourth of the humidifier bottle 105 that remains full. Accordingly, if all four of the LEDs 250–280 were illuminated, the bottle 105 would be filled to capacity. If only the LEDs 250 and 260 were illuminated, the bottle 105 would be half-full, and, if none of the LEDs 250–280 were illuminated, the bottle 105 would be empty. The specific number of LEDs used to indicate the water level could comprise any number and, thus, need not necessarily be limited to the four LEDs 250–280 shown. Such visual indication of the water level either via the digital readout 240 or LEDs 250–280 would provide a discrete indication of the water level, which could be quickly determined by an individual. This particular embodiment also enables the individual to ascertain the water level of the bottle 105 from a distant location from the humidifier 100.

In addition to the "water level" LEDs 250–280, in one embodiment another LED 290 is provided on the humidifier 100 to indicate that the bottle 105 is completely empty and, thus, need be re-filled. Also, different colored LEDs could be used to distinguish between the "water level" LEDs 250–280 and the "refill" LED 290 when viewed in a dark environment. For example, the "water level" LEDs 250–280 could be green in color and the "refill" LED 290 could be red. This would aid an individual to quickly ascertain whether the LED 250 is illuminated (i.e., one-quarter of the bottle 105 is full of water) or whether the LED 290 is illuminated (i.e., the bottle 105 is empty and needs to be refilled), especially when viewed in a dark room (e.g., at nighttime). In yet another embodiment, a single LED is provided, which is adapted to illuminate when the bottle 105 is empty, thus functioning as an "empty" indicator, signaling the user to re-fill the bottle 105.

In accordance with another embodiment, the humidifier 100 is provided with a limit switch 160 (as shown in FIG. 2). When the bottle 105 is orthogonal to the bottom surface of the humidifier 100 (in the given. vertical position), the humidifier 100 would be automatically turned off via the limit switch 160. Configuring such a switch 160 is well within the knowledge of one of ordinary skill in the art. This would prevent the humidifier 100 from running when the humidifier bottle 105 is empty.

Figure 8A:
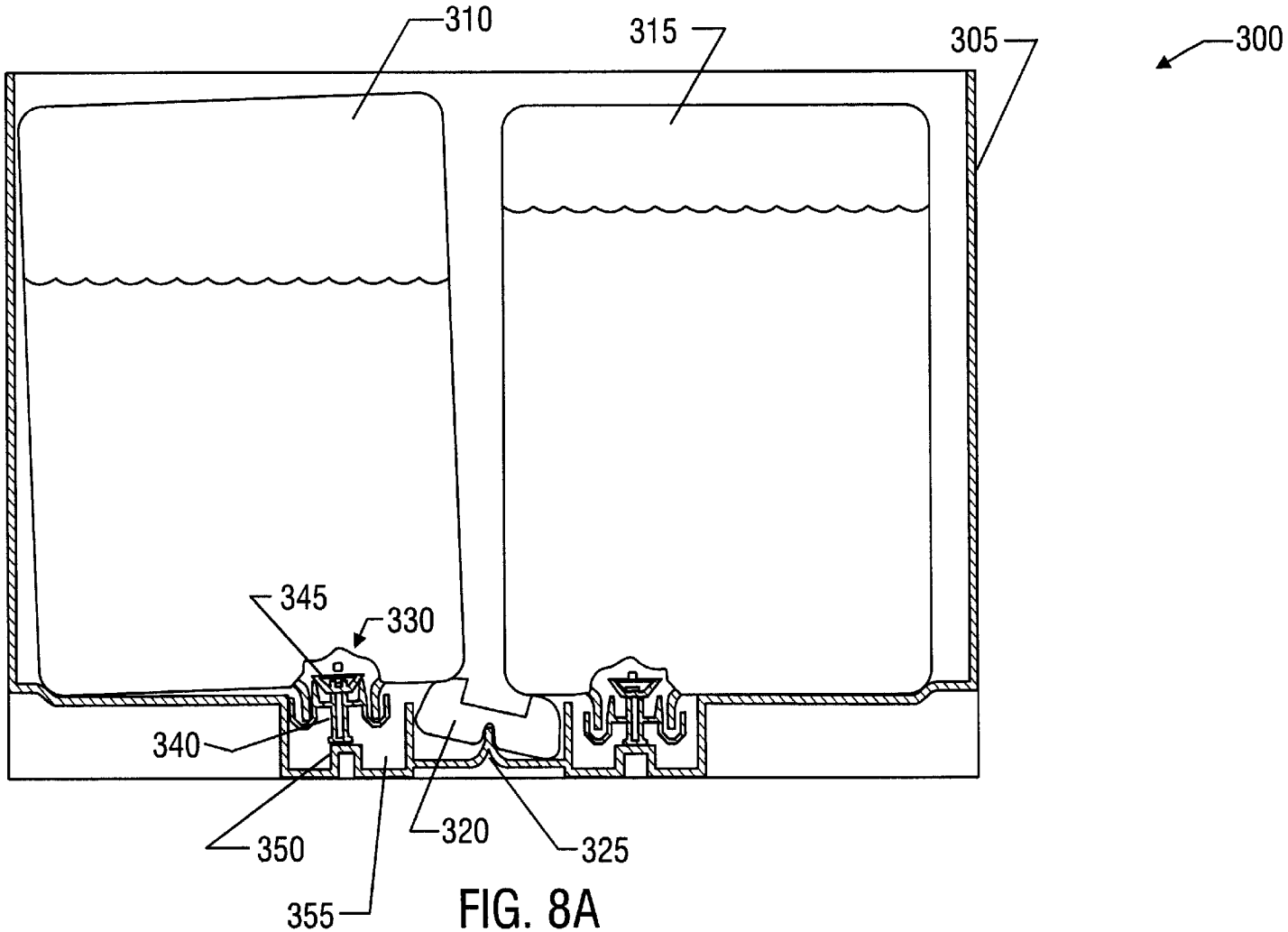
FIGS. 8A and 8B illustrate a humidifier bottle receptacle for a humidifier with a pivot mechanism for alternately dispensing water to the humidifier via two humidifier bottles in accordance with one embodiment.

Some humidifiers employ a plurality of humidifier bottles for supplying water to the reservoir. Turning now to FIG. 8A, a humidifier bottle assembly 300 for alternately supplying water to a humidifier from two bottles is shown in, accordance with one embodiment of the invention. The humidifier bottle assembly 300 includes a humidifier bottle receptacle 305 for connection to the humidifier (not shown) for supplying water thereto. The humidifier bottle assembly 300 further includes first and second humidifier bottles 310 and 315 disposed in the receptacle 305 for supplying water to the humidifier.

Typically, with a conventional two-bottle variety humidifier, a first humidifier bottle will empty completely before a second humidifier bottle will commence drainage of water contained therein. Usually, an individual will notice that the first bottle is empty and will refill the empty bottle. When placed back on the humidifier, the humidifier will usually draw water again from the re-filled humidifier bottle, thus causing the drainage of water from the second humidifier bottle to cease. As a result, the water in the second humidifier bottle tends to undesirably stagnate.

Figure 9:
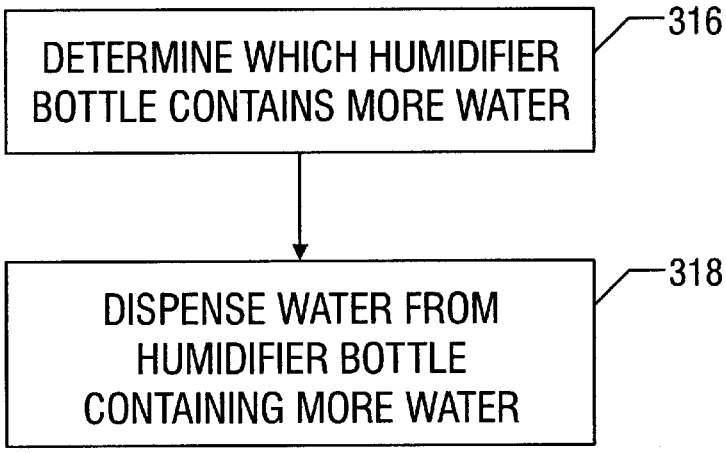
FIG. 9 shows a process for alternately dispensing water from the two humidifier bottles of FIGS. 8A and 8B.

To alleviate such stagnation, the humidifier bottle receptacle 305 of the present invention facilitates alternate drainage of water from each humidifier bottle 310, 315. To accomplish such, water is dispensed from the bottle 310, 315 containing the most water; in other words, the heaviest bottle 310, 315. FIG. 9 illustrates a process for dispensing water from a plurality of water bottles in accordance with the present invention. In block 316, a determination as to which bottle contains the most water is made. In block 318, water is dispensed from the bottle containing the most water, as determined in block 316, and the process repeats.

Figure 8B:
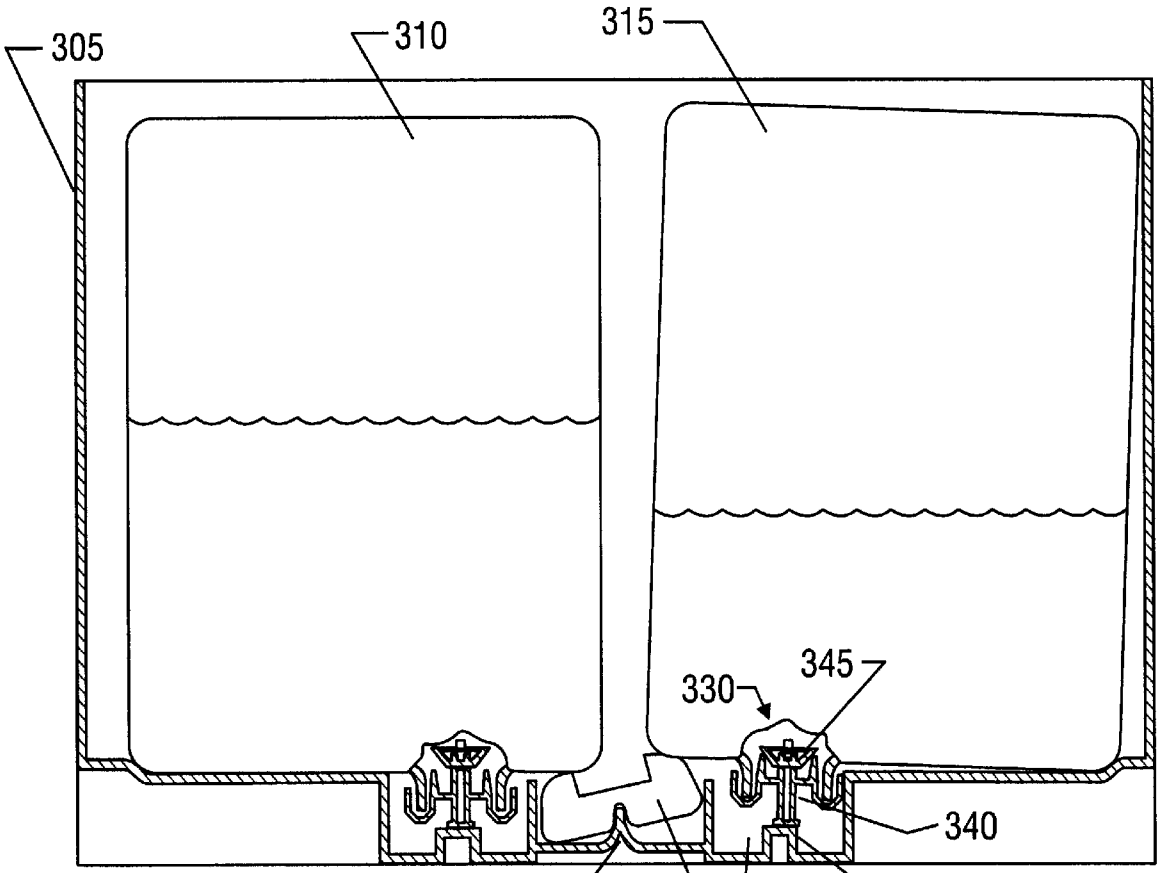

Referring to FIGS. 8A and 8B, the humidifier bottle receptacle 305 includes a pivot mechanism 320 that pivots upon a pivot point 325, which extends from the bottom of the humidifier bottle receptacle 305 between the bottles 310, 315. The pivot mechanism 320 supports the bottom right and left corners of the humidifier bottles 310 and 315, respectively. As illustrated in FIG. 8A, the second bottle 315 contains more water than the first bottle 310. Thus, it is heavier, causing the pivot mechanism 320 to raise the first bottle 310.

As the water level of the second bottle 315 falls below the water level of the first bottle 310, the second bottle 315 becomes lighter in weight than the first bottle 310. As this occurs, the pivot mechanism 320 will cause the second bottle 315 to rise as the first bottle 310 (now being heavier) forces the pivot mechanism 320 down, thus lowering the first bottle 310, as illustrated in FIG. 8B.

Each humidifier bottle 310, 315 has disposed on its bottom portion a dispensing mechanism 330 for dispensing water from their respective humidifier bottles 310, 315 to the humidifier. As the humidifier bottle 310, 315 is lowered, a dispensing plunger 340 causes a stopper 345 to rise as the dispensing plunger 340 rests on a plunger seat 350, allowing for water release from the respective bottle 310, 315. When the humidifier bottle 310, 315 is elevated within the humidifier bottle receptacle 305, the dispensing plunger 340 disengages from the plunger seat 350, allowing the stopper 345 to return to its closed position. As a result, the stopper 345 closes the gap for water release, thus preventing water to drain from the humidifier bottle 310, 315.

As shown in FIG. 8A, when the lighter humidifier bottle 310 rises as a result of the pivot mechanism 320, the bottle 310 is raised within the water-dispensing receptacle 335. This causes the dispensing plunger 340 to disengage from the plunger seat 350 and drop the stopper 345 to close the gap for water release into the water-dispensing receptacle 335 from the bottle 310. A coil spring (not shown), for example, may be situated around the stem of the plunger 340 to bias the stopper to a normally closed position. On the other hand, while the heavier bottle 315 forces the pivot mechanism 320 down, the dispensing plunger 340 of the bottle 315 engages with the plunger seat 350. As a result, the stopper 345 rises and opens the gap for water flow from the bottle 315 into the water-dispensing receptacle 335, and, subsequently, to the humidifier unit.

As the water level of the humidifier bottle 315 drops, it eventually will become lighter in weight than the humidifier bottle 310, which forces the pivot mechanism 320 down on the left side of the pivot 325, as shown in FIG. 8B. As a result, the dispensing plunger 340 of the bottle 315 disengages from the plunger seat 350 of the water-dispensing receptacle 335, thus causing the stopper 345 to close the gap to prevent water release from the bottle 315. The heavier weight of the bottle 310 causes the engagement of its dispensing plunger 340 with the plunger seat 350. As a result, the stopper 345 of the bottle 310 raises and opens the gap for water release from the humidifier bottle 310 into the water-dispensing receptacle 335.

The pivot mechanism 320 will continue to "rock" back and forth on the pivot point 325 as each of the bottles 310, 315 becomes the heavier bottle. Accordingly, this process will alternately dispense water from the bottles 310, 315 to the humidifier, thus causing the bottles 310, 315 to each release water intermittently. Accordingly, such arrangement significantly reduces the likelihood that water will stagnate in either of the bottles 310, 315.

The mechanical (i.e. lever and fulcrum) determination of the heavier of the two bottles is exemplary. Other methods of determining which of the two bottles is heavier, then dispensing water from the heavier bottle may be used. For example, the water level of the humidifier bottles 310 and 315 could be determined by sensors configured to determine which of the humidifier bottles 310, 315 is the heaviest. In response to the sensors, water would then be dispensed from the heavier of the humidifier bottles 310, 315.

Figure 10:
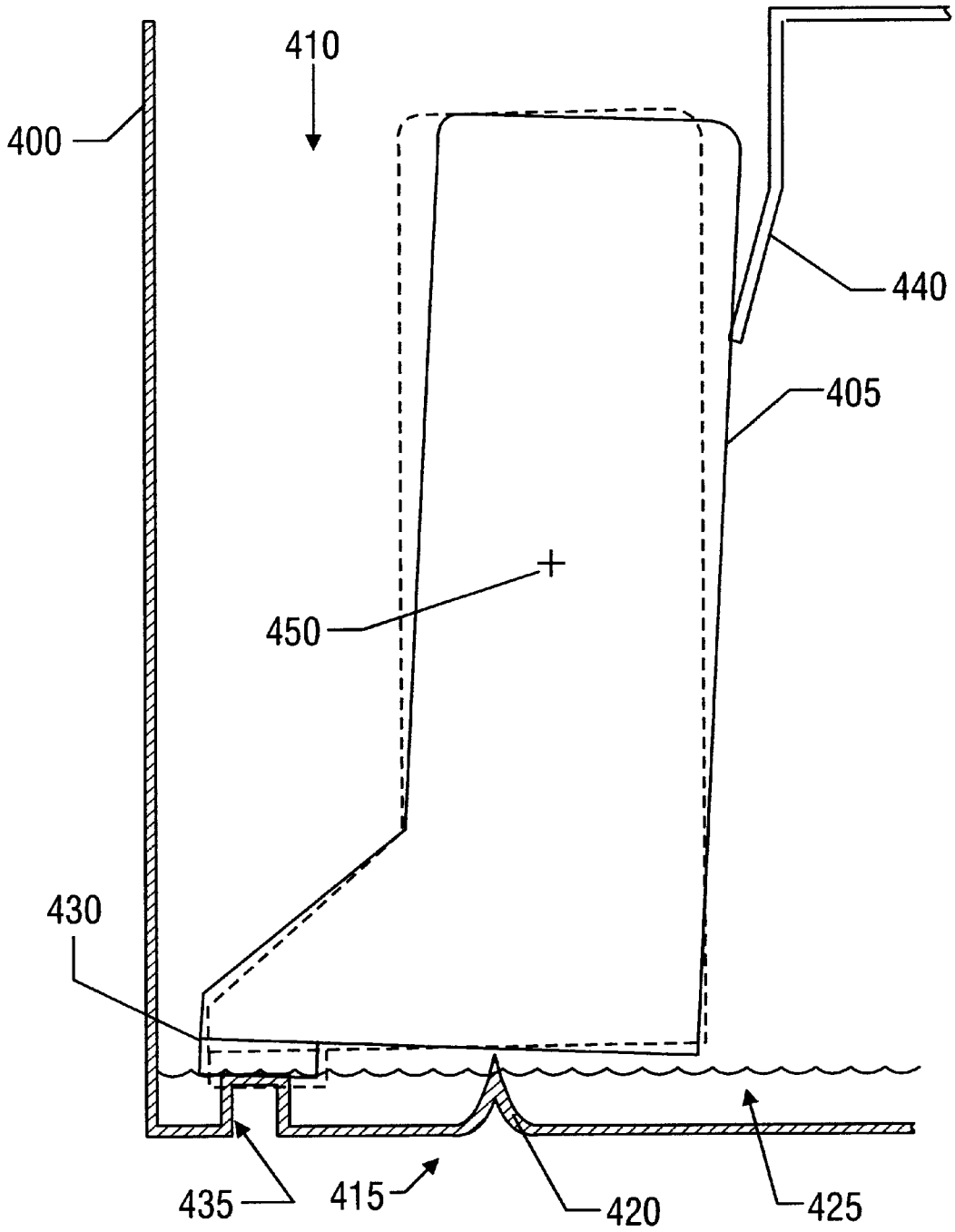
FIG. 10 depicts a humidifier bottle assembly utilizing a spring force for alternately dispensing water to a humidifier from two humidifier bottles in accordance with another embodiment.

Turning now to FIG. 10, a humidifier 400 having a humidifier bottle assembly in accordance with yet another embodiment of the present invention is illustrated. The humidifier bottle 405 is disposed within a humidifier bottle receptacle 410 of the humidifier 400. The humidifier bottle receptacle 410 includes on its bottom surface a mounting seat 415, which extends from the bottom of the humidifier 400, and provides vertical support to the humidifier bottle 405 via a pivot point 420. The mounting seat 415 further includes a shallow water receptacle 425 (i.e., a reservoir) for receiving water from the bottle 405 via a dispensing cap 430 mounted on the bottom surface of each respective bottle 405. A seat 435 is disposed within the reservoir 425, positioned to contact the dispensing cap 430. The dispensing cap 430 is of the type illustrated in FIGS. 8A and 8B. Hence, it includes a dispensing plunger that causes a stopper to rise as the dispensing plunger contacts the seat 435, allowing water to flow out of the bottle 405.

The humidifier bottle receptacle 410 further includes a biasing member 440 mounted on one side of the receptacle 410, which tends to situate the bottle 405 in an upright (i.e., orthogonal) position relative to the bottom surface of the humidifier 400. In one embodiment, the biasing member 440 is a plastic tab; however, it will be appreciated that the biasing member 440 could be embodied as a coil spring or other elastic-type materials, without departing from the spirit and scope of the present invention.

The center of gravity of the bottle 405, designated as the point 450 in FIG. 10, is positioned between the pivot point 420 of the mounting seat 415 and the spring force 440. Such positioning causes the bottle 405 to tilt backwards (opposite the dispensing cap 435) towards the biasing member 440. When the bottle 405 is filled to capacity (i.e., at its heaviest weight), it will apply maximum pressure to the biasing member 440. As the bottle 405 drains its water into the water receptacle 425, it becomes lighter, and, consequently, applies less pressure to the biasing member 440. Thus, as the humidifier bottle 405 empties, the biasing member 440 causes the bottle 405 to move towards a vertical position (i.e., orthogonal to the mounting seat 415). As with the humidifier bottle assembly illustrated in FIG. 2, the angular position of the bottle 405 and/or the force applied to the biasing member 440 may be used to convey information regarding the amount of water contained in the humidifier bottle 405.

The exemplary humidifier bottles illustrated in FIG. 2 and FIG. 10 may be configured to provide a humidifier bottle assembly that dispenses water alternately from two bottles. For example, referring to FIG. 10, a second humidifier bottle 405 may be situated in the mounting seat 415, such that the humidifier contains two bottles for dispensing water into the reservoir 425. The second bottle (not shown) appears directly behind the bottle 405 shown in FIG. 10, and is oriented in the humidifier bottle receptacle 410 in much the same way as the bottle 405 shown.

When the plunger of the dispensing cap 430 of the first bottle 405 contacts the seat 435, water will flow out of the first bottle. The first bottle 405 will become lighter as water is dispensed therefrom, and the biasing member 440 will move the bottle 405 towards a vertical position. Consequently, the dispensing cap 430 is lowered into the water contained in the reservoir 425. As the dispensing cap 430 contacts the water, incoming air is shut off to the first bottle 405, such that the bottle 405 will no longer disperse water.

The second bottle (not shown) has not yet dispensed water, and thus, still remains in the maximum tilted position with its dispensing mechanism 430 above the water in the reservoir 425. Therefore, it will dispense water until the biasing member 440 causes the dispensing mechanism 430 to be positioned lower than that of the first bottle 405. At that time, the dispensing sequence is again reversed. Thus, the water is dispensed from the heavier of the two bottles. The depth of the reservoir 425 must be constructed to allow for an uneven distribution of water within the reservoir 425 due to the humidifier 400 being seated on an unlevel floor. Additional bottles may be added to the humidifier 400 in the manner described to provide a multi-bottle assembly.

Further, it would be a routine undertaking for one skilled in the art having the benefit of this disclosure to configure a second water bottle of the type illustrated in FIG. 2 to achieve a two-bottle system similar to that disclosed herein above in conjunction with the bottle 405 of FIG. 10.

The particular embodiments disclosed above arc illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A humidifier bottle assembly, comprising:

a first and a second humidifier bottle adapted to hold water; and a humidifier bottle receptacle adapted to receive the first and second bottles, the receptacle including:

a device adapted to determine which of the first and second humidifier bottles contains more water, the device being operable to dispense water from the humidifier bottle containing more water.

2. The humidifier bottle assembly of claim 1, wherein the device includes a pivot mechanism configured to raise one of the first and second bottles and lowers the other of the first and second bottles within the receptacle.

3. The humidifier bottle assembly of claim 2, wherein the bottle that is raised within the receptacle is the one of the first and second bottles bottle containing less water.

4. The humidifier bottle assembly of claim 2, wherein the bottle that is lowered within the receptacle is the one of the first and second bottles containing more water.

5. The humidifier bottle assembly of claim 1, wherein the first and second bottles each include:

a dispensing mechanism adapted to prevent or allow the release of water from the first and second bottles.

6. The humidifier bottle assembly of claim 5, wherein the dispensing mechanism includes:

a stopper adapted to prevent the flow of water from its corresponding first or second bottle;

a dispensing plunger adapted to raise or lower the stopper, wherein when the stopper is lowered by the dispensing plunger, water does not flow from its corresponding bottle; and wherein when the stopper is raised by the dispensing plunger, water flows from its corresponding bottle.

7. The humidifier bottle assembly of claim 6, wherein the receptacle includes:

a pair of plunger seats adapted to engage with said dispensing plunger from each respective bottle;

wherein when the pivot mechanism lowers the heavier bottle, the plunger seat corresponding to the heavier bottle engages the dispensing plunger of the heavier bottle to cause water to flow from the heavier bottle; and wherein when the pivot mechanism raises the lighter bottle, the plunger seat corresponding to the lighter bottle disengages from the dispensing plunger of the lighter bottle to prevent the flow of water from the lighter bottle.

8. A method for dispensing water from a humidifier bottle assembly, said humidifier bottle assembly including at least two humidifier bottles for holding water, said method comprising:

determining which of said humidifier bottles contains more water than the other humidifier bottle; and dispensing water from said humidifier bottle containing the most water.

9. The method of claim 8, wherein said determining further comprises:

determining which of said humidifier bottles is the heaviest.

10. The method of claim 8, wherein said determining further comprises:

determining which of said humidifier bottles has the highest water level.

11. The method of claim 8, wherein said determining further comprises:

mechanically determining which of said humidifier bottles contains more water than the other humidifier bottle.

12. The method of claim 11, wherein the humidifier bottle assembly includes two bottles, and wherein:

the mechanically determining act further comprises situating at least a portion of each humidifier bottle on opposite ends of a pivot mechanism configured to pivot about a pivot point, such that the heavier of the bottles forces the respective end of the pivot mechanism down; and the dispensing water act further comprises dispensing water from the bottle that forces the respective end of the pivot mechanism down.

13. The method of claim 10, wherein said determining further comprises:

providing at least one sensor configured to determine which bottle has the highest water level, and wherein said dispensing further comprises dispensing water from said humidifier in response to the at least one sensor.

14. A humidifier, comprising:

a reservoir adapted to contain water;

a wick adapted to be wetted by water contained in the reservoir;

first and second humidifier bottles adapted to provide water to the reservoir;

a pivot mechanism configured to pivot about a pivot point, the first and second bottles being situated on opposite ends of the pivot mechanism such that the pivot mechanism lowers the heavier of the first and second bottle; and first and second dispensing mechanisms coupled to the first and second humidifier bottles, respectively, the dispensing mechanisms configured to dispense water from the one of the first or second humidifiers lowered by the pivot mechanism.

15. The humidifier of claim 14, wherein the dispensing mechanisms each comprise:

a stopper having an open position wherein water is allowed to flow out of the respective bottle and a closed position wherein water is prevented from flowing out of the respective bottle, and a plunger operable to move the stopper between the open and closed positions in response to the respective humidifier bottle being lowered and raised by the pivot mechanism.

* * * * *